US007562772B2

(12) United States Patent
Lutzig

(10) Patent No.: US 7,562,772 B2
(45) **Date of Patent: *Jul. 21, 2009**

(54) CONTAINER BLANK FOR A BOX WITH HINGED LID

(75) Inventor: Bodo-Werner Lutzig, Chavornay (CH)

(73) Assignee: Philip Morris USA Inc., Richmond, VA (US)

( * ) Notice: Subject to any disclaimer, the term of this patent is extended or adjusted under 35 U.S.C. 154(b) by 122 days.

This patent is subject to a terminal disclaimer.

(21) Appl. No.: 11/415,083

(22) Filed: May 2, 2006

(65) Prior Publication Data

US 2006/0283732 A1 Dec. 21, 2006

Related U.S. Application Data

(63) Continuation of application No. 10/467,761, filed as application No. PCT/EP02/01477 on Feb. 13, 2002, now Pat. No. 7,044,294.

(30) Foreign Application Priority Data

Feb. 13, 2001 (DE) ..... 101 06 549

(51) Int. Cl.
*B65D 85/10* (2006.01)

(52) U.S. Cl. ..... 206/259; 206/268; 206/271; 206/273

(58) Field of Classification Search ..... 206/259, 206/266, 268, 273, 265, 271
See application file for complete search history.

(56) References Cited

U.S. PATENT DOCUMENTS

| | | | |
|---|---|---|---|
| 2,523,251 | A | 9/1950 | Pantalone et al. |
| 4,753,384 | A | 6/1988 | Focke et al. |
| 4,763,779 | A | 8/1988 | Focke et al. |
| 4,923,059 | A | 5/1990 | Evers et al. |
| 4,955,531 | A | 9/1990 | Graboyes |
| D322,687 | S | 12/1991 | Tschudin |
| 5,143,282 | A | 9/1992 | Pham |
| 5,207,322 | A | 5/1993 | Focke et al. |
| 5,341,925 | A | 8/1994 | Fleenor et al. |
| 5,392,905 | A | 2/1995 | Focke et al. |
| 5,435,440 | A | 7/1995 | Focke et al. |
| 5,478,011 | A | 12/1995 | Pham |

(Continued)

FOREIGN PATENT DOCUMENTS

| | | |
|---|---|---|
| CH | 197747 | 8/1938 |

(Continued)

OTHER PUBLICATIONS

English translation of Japanese Office Action dated Sep. 14, 2006.

*Primary Examiner*—Bryon P Gehman
*Assistant Examiner*—Ernesto A Grano
(74) *Attorney, Agent, or Firm*—Buchanan Ingersoll & Rooney PC

(57) ABSTRACT

A container blank is provided for a box with a hinged lid wherein the lid is reliably closed by way of an enlarged collar section. The closure of the box can be aided by surfaces formed on the container blank such that when folded into a box, the surfaces of the closure can provide resistance to the lid opening. Additionally, a lid portion of the container blank can optionally be provided with an embossed section.

12 Claims, 3 Drawing Sheets

U.S. PATENT DOCUMENTS

Figure 1:
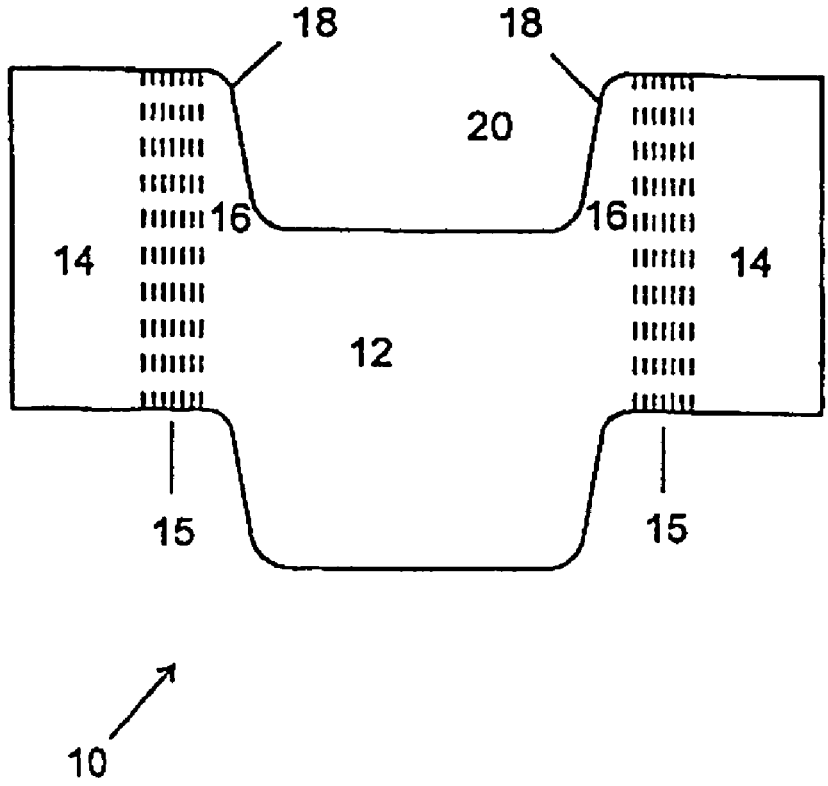

| | | | | |
|---|---|---|---|---|
| 5,904,244 | A * | 5/1999 | Focke et al. | 206/268 |
| D441,496 | S | 5/2001 | Focke et al. | |
| 6,343,691 | B1 | 2/2002 | Focke et al. | |
| 6,360,943 | B1 * | 3/2002 | Focke et al. | 229/160.1 |
| 6,457,580 | B1 | 10/2002 | Focke et al. | |
| 6,843,041 | B2 | 1/2005 | Focke et al. | |
| 7,044,294 | B2 | 5/2006 | Lutzig | |

FOREIGN PATENT DOCUMENTS

| | | | |
|---|---|---|---|
| CH | 219033 | | 5/1942 |
| CH | 237898 | | 9/1945 |
| DE | 3329454 | A1 | 3/1985 |
| DE | 4103612 | A1 | 8/1992 |
| DE | 4109702 | A1 | 9/1992 |
| EP | 0434962 | A1 | 7/1991 |
| EP | 0900736 | A2 | 3/1999 |
| GB | 349970 | | 6/1931 |
| GB | 2032887 | A | 5/1980 |
| JP | 53-50714 | | 5/1978 |
| JP | 16334/87 | | 1/1987 |
| JP | 135477/92 | | 5/1992 |
| JP | 04-279446 | | 10/1992 |
| JP | 85536/93 | | 4/1993 |
| JP | 40050/97 | | 2/1997 |
| WO | WO 00/43289 | A1 | 7/2000 |
| WO | WO 02/064450 | A1 | 8/2002 |

* cited by examiner

CONTAINER BLANK FOR A BOX WITH HINGED LID

This application is a continuation of and claims priority under 35 U.S.C. § 120 to U.S. application Ser. No. 10/467,761, filed on Feb. 17, 2004, which issued as U.S. Pat. No. 7,044,294, and corresponds to International Application No. PCT/EP02/01477, filed on Feb. 13, 2002, which claims priority of German Patent Application No. 10106549.3, filed Feb. 13, 2001, the entire contents of which are hereby incorporated by reference.

The invention relates to a FLIP-TOP® box, in particular for cigarettes, with a lid and box part, the rear wall of which is linked to the rear wall of the lid part. The box also has a collar with a collar front wall and collar side walls and with a cut-out section in the collar front wall, the collar being arranged on the inside of the box front wall and the box side walls and projecting partly out of the box part.

Such FLIP-TOP® or hinge-lid boxes are the most common cigarette boxes alongside soft-pack packs. In the standard form, these hinge-lid boxes have a rectangular cross-section, i.e. the longitudinal edges are approximately right-angled. More recently however, there have also been increasing numbers of FLIP-TOP® boxes with chamfered longitudinal edges (i.e. an 8-cornered cross-section) or rounded-off longitudinal edges. With all these FLIP-TOP® boxes, the problem arises that, in particular after frequent opening and closing, the lid does not remain automatically in the closed position, but opens somewhat. This leads to an increased loss of aroma and moreover tobacco crumbs for example can fall into the pockets of the consumer in undesired manner.

To solve this problem, the hinge-lid packs customary in the trade have indents on the longitudinal edges of the collar. This has the effect that when the collar is folded, the material enclosed by the indents projects laterally like ears. Thus upon closure of the lid, an additional frictional resistance is produced which ensures a better closure of the lid. The disadvantage here, however, is that with frequent opening and closing, in particular with boxes with rounded-off and chamfered longitudinal edges, the projecting collar parts are bent or folded and fit into the indent with the result that the additional friction is lost again.

EP 0 434 962 B1 provides a two-layer lid front wall to solve this problem. The inside of the lid front wall is provided with recesses which, upon closure of the lid, come into contact with rims remaining beside the cut-out section of the collar front wall such that part of these rims come to lie between the inside and the outside of the lid front wall. An increased friction between lid and collar and thus a better closure of the lid also results from this.

U.S. Pat. No. 5,478,011 also operates with indents or recesses on the inside of the lid front wall in order to achieve as secure as possible a closure of the lid. In addition, in this document, an embossed area on the inside of the lid front wall is also described so that a cavity results between outside and inside of the lid front wall. This facilitates the insertion of the collar rims between outside and inside of the lid front wall.

A disadvantage in the solution proposals of EP 0 434 962 B1 and U.S. Pat. No. 5,478,011 is that, in addition to an increased material outlay, a more complicated production process with additional process steps, combined with the provision of additional indents or recesses, is also necessary.

The object of the present invention is therefore to provide a FLIP-TOP® box, in particular with chamfered or rounded-off longitudinal edges, with secure closure of the lid, which can be produced in the simplest possible manner.

This object is achieved by a box made of foldable material such as for example paper, cardboard, plastic, plastic film, plastic laminate, with a box part, the box part having a box front wall, a box rear wall, box side walls and a box base, with a lid part, the lid part having a lid front wall, a lid rear wall, lid side walls and a lid top side, and with a collar, the collar having a collar front wall provided with a cut-out section and collar side walls, the lid part being linked with the lid rear wall on the box rear wall, the collar being arranged in the box part and the collar front wall and as a rule also the collar side walls projecting at least partly out of the box part, characterized in that the rim of the collar front wall remaining on the left and right next to the cut-out section is so narrow that it projects forward due to the rigidity of the foldable material, in particular in its upper area. In other words, as a result of a simple broadening of the cut-out section in the collar front wall and the thereby resulting projection of the rims of the collar front wall, an increased friction between these rims and the inside of the lid front wall is achieved with the result that the lid is held essentially in the closed state.

In order to achieve the desired effect of an increased friction through the forward-projecting rims of the collar front wall, a small increase in the breadth of the cut-out section compared with customary cigarette boxes is already sufficient, for example an increase of 3% or more, in particular 4 to 15%, preferably 4 to 7%, particularly preferably 4 to 5 and approximately 4%.

With a box customary in the trade (with a maximum breadth of the collar part in the box of 5.6 cm) in which all longitudinal edges are rounded off, this means in practice a broadening of the cut-out section by approx. 1.5 mm. In other words the cut-out breadth at half height (mid-height calculated from the bottom edge of the cut-out section to the maximum height of the cut-out section, which in customary cigarette boxes is defined by the horizontally running top edges of the rims of the collar front wall or of the collar side walls) is approximately 3.25 cm. If this breadth is increased at mid-height by 1.5 mm or approximately 4.5% to 3.40 cm, the desired effect of a clearly increased friction already occurs. This effect is also already to be seen with a cut-out section broadening of only approx. 3%, but becomes all the more pronounced with an increase in the cut-out section breadth or with a reduction of the breadth of the laterally remaining rims, an upper limit of approx. 20% being set however by the overall breadth of the box.

The cut-out section broadening can also be given by the ratio of the mid-height breadth of the cut-out section to the maximum breadth of the collar part in the finished box. This is approximately 0.74 for FLIP-TOP® boxes of the state of the art with rectangular longitudinal edges, and approximately 0.69 with chamfered or round longitudinal edges. For the boxes according to the invention with rectangular longitudinal edges, this ratio is to be greater than 0.76, preferably 0.78 to 0.81, and for the boxes according to the invention with chamfered or round longitudinal edges, greater than 0.71, preferably 0.72 to 0.73.

Preferably, one or more, in particular all the longitudinal edges or only the two front longitudinal edges on the side of the opening of the FLIP-TOP® boxes according to the invention are rounded off or chamfered because the remaining rim areas beside the cut-out section of the collar front wall then project forward particularly markedly and therefore contribute particularly well to the secure closure of the lid. With the customary FLIP-TOP® boxes with essentially rectangular edges, this effect is not so strongly pronounced with the result that for these a greater cut-out section broadening, in particular of 5 to 10%, is preferred.

In order to achieve rounded-off or chamfered edges, the pre-cut sheet from which the cigarette box is produced is provided either with grooves or scoring lines at the areas forming the edges of the cigarette box. According to U.S. Pat. No. 4,955,531, the grooves can be produced in a form in which the pre-cut sheet is indented by a grooving unit at the relevant points. On the opposite side there is a groove channel into which the material of the pre-cut sheet can be pressed. In the case of parallel-running grooves, a corrugated cross-section is produced according to the described process. An alternative to grooves are scoring lines. The thickness of the material forming the pack is hereby reduced using a scoring knife. For this purpose, the pre-cut sheet is placed on a flat support and worked with a scoring knife with the result that, in addition to a compression, material can also be removed. Depending on the shape of the scoring knife, for example a v- or u-shaped cross-section is formed. As the support does not have channels at points opposite the scoring knife, as in the production of grooves, but rather a flat surface, a reduction in thickness results and not, as in the case of the grooves, a deformation without a reduction in thickness. The extent of the reduction in thickness depends on the material used, but as a rule will be 10 to 80% of the overall thickness, preferably 20 to 70%, quite particularly preferably 40 to 50%. The scoring lines are preferably located on the side of the pre-cut sheet which forms the inside in the finished box. This has the advantage of a more attractive optical appearance of the finished box. The scoring lines and grooves preferably extend over the whole length of the box with the result that completely round or chamfered longitudinal edges are obtained.

When the thus-worked pre-cut sheet is folded up, the round (in the case of several grooves or scoring lines per fold area) or chamfered (in the case of two grooves or scoring lines per fold area) edges of the cigarette pack then automatically form along the grooves or scoring lines. The extent and the type of rounding can be fixed by the number of grooves or scoring lines and their distance from one another. 6 to 8, in particular 7, grooves or scoring lines per fold area which are located at a distance of approximately 1 mm from one another are preferred. Upon folding, a box with round edges results; the radius of the rounding then approximately corresponds to that of a cigarette customary in the trade. 2 grooves or scoring lines per fold area which are located at a distance of 6 to 8 mm, in particular approximately 7 mm, from each other are also preferred. Upon folding a box with chamfered (or bevelled) edges then results.

The boxes can be produced from the customary materials for cigarette boxes such as e.g. paper, cardboard, plastic, plastic film or plastic laminate or one of the named materials with an additional metal or metal-oxide coating.

Paper or cardboard are preferably used, shortgrain paper or shortgrain cardboard are particularly preferred as foldable material for the lid and the box part and also the collar. In the case of paper or cardboard production, the product-forming material is placed on a fast-moving belt. This has the effect that the long fibres in the material preferably orient themselves in longitudinal direction. Depending on whether the pre-cut sheet is later cut along or across the finished material web, the long fibres in the pre-cut sheet are arranged across the longitudinal axis of the pre-cut sheet (shortgrain) or longitudinal to the longitudinal axis of the pre-cut sheet (longgrain). The result of the orientation of the fibres across the longitudinal direction of the shortgrain pre-cut sheet is a good flexibility about the transverse axis, but a poor flexibility about the longitudinal axis. The elastic restoring forces for the lateral gluing are therefore stronger than with longgrain pre-cut sheets in which, due to the transposed position of the long fibres in the material, the conditions are exactly the opposite. On the other hand however, shortgrain pre-cut sheets are preferably used for FLIP-TOP® boxes, as they clearly favour the stability of the lid (no crooked closures, no easy tearing-off of the lid), the rigidity of the pack as a result of a higher stability in the transverse direction and the flat position of the pack, i.e. as small a curvature of the pack as possible, compared with the use of longgrain materials.

For the boxes according to the invention therefore, the use of shortgrain materials is preferred because on the one hand these produce the named positive properties for the lid and box part such as stability of the lid and rigidity and flat position of the pack, on the other hand the projection of the rims of the collar front wall is still further increased by the elastic restoring forces increased with shortgrain materials due to the orientation of the long fibres across the longitudinal axis of the collar.

The use of shortgrain materials for the production of FLIP-TOP® boxes with chamfered or rounded-off longitudinal edges is somewhat problematic because on the one hand (as discussed above) the elastic restoring forces are increased, on the other hand the lateral surfaces for gluing are smaller than with normal boxes as a result of the chamfered or rounded-off edges. The residence times upon gluing must therefore be increased, which leads to a slowing-down of production.

In order to avoid this problem, it is preferred with the boxes according to the invention with rounded-off or chamfered longitudinal edges that the fold lines which lead to the chamfered or rounded-off edge are formed by scoring lines in the case of the lid and box part. Through the scoring lines, unlike grooves, the elastic restoring forces are surprisingly clearly reduced with the result that the production of the boxes according to the invention can also be carried out problem-free and swiftly with shortgrain materials without problems arising with the lateral closure of the boxes as a result of the smaller available gluing surface.

Unlike the box and lid part, it is however preferred with the boxes according to the invention with rounded-off or chamfered edges that the elastic restoring forces of the collar part are not reduced. It is therefore preferred that the fold lines of the collar which produce the chamfering or rounding-off between collar front wall or collar side walls are formed by grooves because the outer rims of the collar front wall then project more markedly forward and the friction with the inside of the lid in closed state is increased.

For the collar part, in addition to the shortgrain materials described, the longgrain materials usually used for collars can also be used however, preferably again in combination with grooves in order to reduce the elastic restoring forces as little as possible and to ensure as effective as possible a projection of the collar front wall rims.

To improve the closure of the lid still further, the inside of the lid front wall can be formed by a strengthening field with at least one, preferably two recess(es) which is/are shaped such that upon closure of the lid part it/they interacts/interact with the edge(s) of the collar rim(s) so that in the closed state of the box at least a part of the collar rim/rims comes/come to rest between the outside of the lid front wall and the strengthening field.

In order to ensure that the interaction between the recess and the collar rim runs problem-free, the recesses are essentially v-shaped, their edges curved (so that the collar edges can easily slide under the strengthening field), the deepest point of the recesses lies roughly at mid-height of the strengthening field and the recesses extend starting at the top edge of the strengthening field over approx. 50 to 90%, in particular 60 to 70%, of the height of this strengthening field (which in turn facilitates the insertion of the collar rims between strengthening field and lid front wall outside).

In order to further facilitate the insertion of the collar rims, one or preferably both top corners of the strengthening field are provided with an embossed area which preferably has the thickness of the foldable material and extends over the whole top corner to the edge of the recess and the top edge of the strengthening field.

The boxes according to the invention are produced in known manner from pre-cut sheets and separate collar parts, i.e. the pre-cut sheets and the collar parts are taken off widths of pre-cut sheet material which are stored on rolls and optionally printed, preferably as shortgrain pre-cut sheets. This is usually followed by a step in which the pre-cut sheets and the collar parts are worked by a scoring knife or a grooving unit in the described manner and at the same time punched and/or cut and optionally embossed. In this step, the broadened collar cut-out section is also retained, which is realizable in terms of process engineering simply by appropriate adaptation of the cutting or punching tool. Provided the pre-cut sheets used for the production of the boxes according to the invention have an embossed area up to the rim of the pre-cut sheet, for manufacturing reasons, the embossing must be carried out first and then the pre-cut sheet cut out or stamped out in a separate step. By customary folding and gluing of the pre-cut sheets at the side surfaces with simultaneous partial insertion and gluing of the collar to the box front wall and/or the box side walls, the finished cigarette box, which usually contains a cigarette group wrapped in an inner liner, is then obtained by machine.

Figure 2:
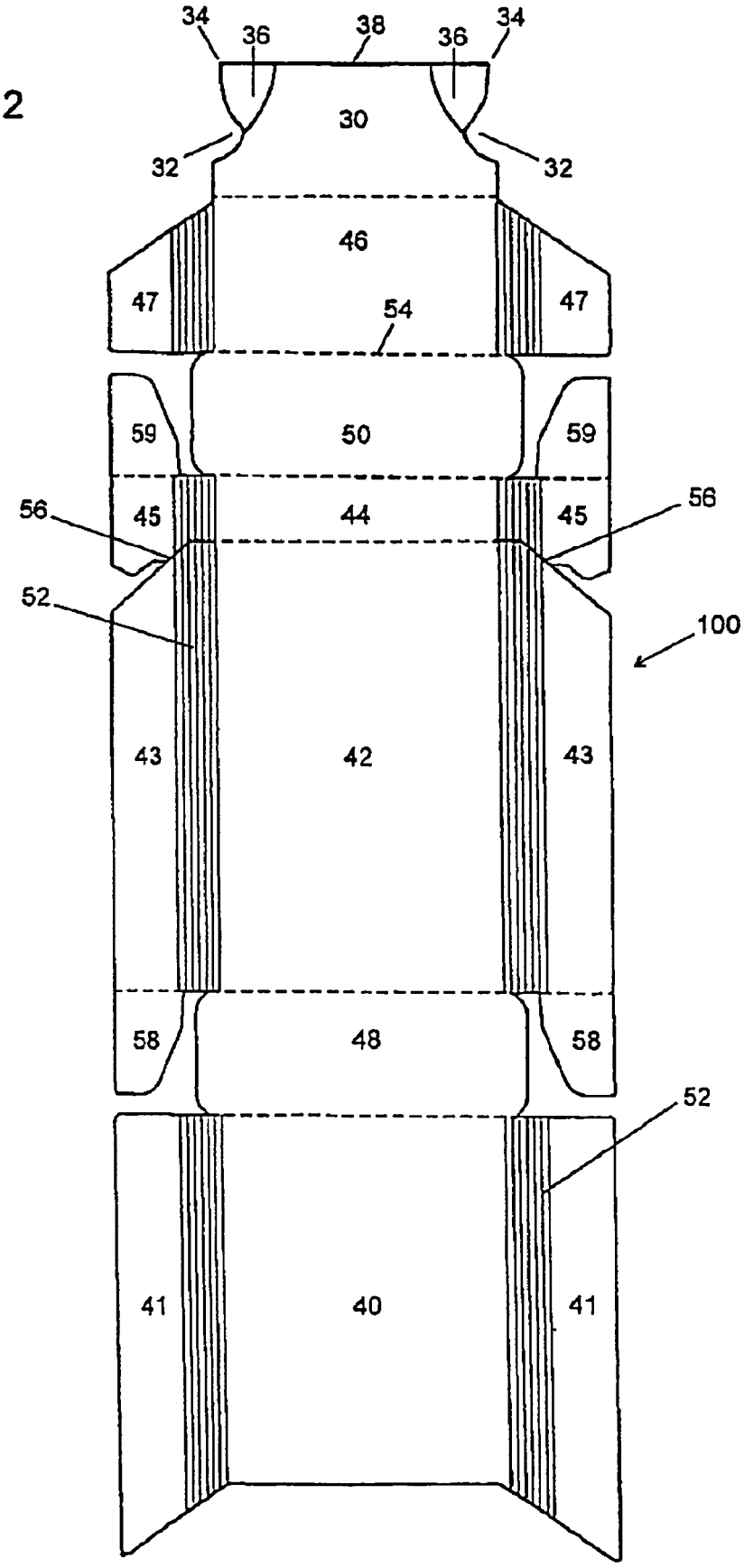

The invention will be explained in more detail in the following using an embodiment. There are shown in:

FIG. 1 a collar pre-cut sheet 10,

FIG. 2 a pre-cut sheet 100 for the box and lid part and

Figure 3:
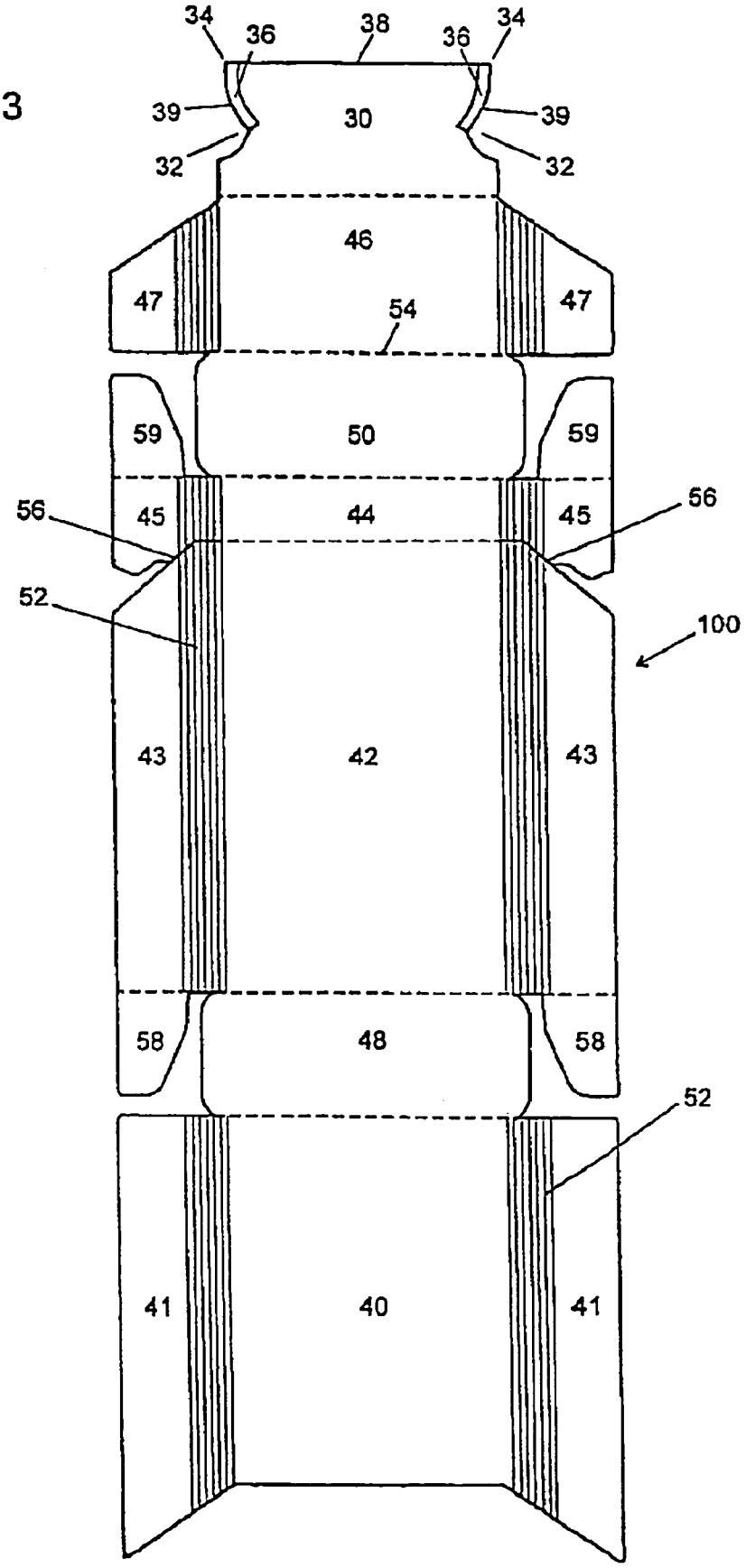

FIG. 3 a further pre-cut sheet 100 with slightly modified strengthening field 30.

FIG. 1 shows a pre-cut sheet made of shortgrain paper or cardboard for a collar 10 with collar front wall 12 and collar side walls 14. Groove lines 15 between collar front wall 12 and the two collar side walls 14 can also be seen. Seven groove lines 15 which run parallel to one another at a distance of approximately 1 mm are provided in total for each fold area. The total fold area is therefore 6 mm wide.

The collar 10 also has the rim areas 16 which are limited by the edges 18 on one side and the fold areas with the grooves 15 on the other side. The collar 10 also has a cut-out section 20 which has a mid-height of approx. 34 mm here. In a box according to the invention which contains the collar shown here, the rims 16 would therefore project forward and thus essentially effect a secure closure of the lid.

FIG. 2 shows a pre-cut sheet 100 made of shortgrain paper or cardboard for the production of a cigarette box. There can be seen the customary fields, i.e. main surface fields 40, 42, 44 and 46 with the corresponding side-surface fields 41, 43, 45 and 47 which, in the finished cigarette box, form the box front wall, the box rear wall, the lid front wall and the lid rear wall as well as the side walls of the lid and box part. Also to be seen are the base field 48 and the top side field 50 which, in the finished box, correspond to the box base and the lid top side. The pre-cut sheet 100 of FIG. 2 has 7 scoring lines 52 running essentially parallel at a distance of approx. 1 mm. Further fold lines alongside the scoring lines 52 are drawn in dotted lines in FIG. 2 and numbered 54. The pre-cut sheet also has two indents 56 and also side-surface field end tabs 58 and 59. The strengthening field 30 which has an approximately v-shaped recess 32 on both sides joins above with the main surface field 46. Each of the two top corners 34 of the strengthening field 30 has an embossed area 36 which extends completely from the top edge 38 of the strengthening field 30 to the deepest point of the recesses 32.

To produce the cigarette box, the side-surface fields 41 can firstly be folded upwards by 90° and the side-surface field end tabs 58 located there folded inwards also by 90°. Then the bottom part of the pre-cut sheet 100 is folded upwards by 90° with the base surface 48 and the first main surface field 40, as a result of which the side-surface field end tabs 58 come into contact with the base field 48 and are glued. If the first main surface field 40 is folded in further (by 90°), the side-surface fields 43 and 41 come to lie on top of one another and can be glued, with the result that the box part is finished. The lid part is produced in similar manner, i.e. the side-surface field end tabs 59 are glued to the top side field 50. The strengthening field 30 is glued inwardly onto the fourth main surface field 46 and thereupon the side-surface fields 45 and 47 glued together. During this production process or subsequently, the collar 10 shown in FIG. 1 for example can be arranged on the inside of the first main surface field 40 such that a part of the collar projects out of the box part. The collar can be connected to the lid front wall, i.e. the first main surface field 40, as well as optionally the corresponding side-surface fields, by gluing.

The strengthening field 30 with the two lateral recesses 32 is then located on the lid front wall inside of the finished box. Upon closure of the box, due to the curved rim pattern of the recesses 32, the edge 18 of the collar rims 16, facilitated by the embossed areas 36, is guided between strengthening field 30 and fourth main surface field 46 and held there by friction.

The embossed areas 36 can also be attached along the cutting lines 39 as shown in FIG. 3.

The invention claimed is:

1. A container blank comprising:

a box part having a box front wall, a box rear wall, box side walls and a box base;

a lid part having a lid front wall, a lid rear wall, lid side walls and a lid top side; and a strengthening field having a recess on each side thereof and wherein the lid rear wall is linked to the box rear wall, wherein the lid front wall is linked to the strengthening field, and wherein each recess has a top and a bottom edge, wherein both the top edge and the bottom edge are curved, wherein each recess is v-shaped, the deepest point of each recess lies roughly at mid-height of the strengthening field, and each recess extends from the top edge of the strengthening field over approximately 50 to 90% of the height of the strengthening field and wherein each recess is shaped such that upon closure of the lid part each recess interacts with an edge of a collar rim so that in the closed state of the box at least a part of the collar rim comes to rest between the outside of the lid front wall and the strengthening field, and at least a portion of the strengthening field is provided with an embossed area, and wherein the embossed area extends inwards from a top edge of the strengthening field and the top edge of each recess into the strengthening field.

2. The container blank according to claim 1, wherein the embossed area extends from the top edge of the strengthening field to the deepest point of each recess.

3. A container blank with a box part, the box part having a box front wall, a box rear wall, box side walls and a box base, with a lid part, the lid part having a lid front wall, a lid rear wall, lid side walls and a lid top side, and with a collar, the collar having a collar front wall provided with a cut-out section and collar side walls, the lid part being linked with the lid rear wall on the box rear wall, the collar being arranged in the box part, and the collar front wall projecting at least partly out of the box part, wherein the rim of the collar front wall remaining on the left and right next to the cut-out section is so narrow that it projects forward due to the rigidity of the foldable material, in at least its upper area, wherein the inside of the lid front wall is formed by a strengthening field having a recess on each side of the strengthening field, and wherein each recess is shaped such that upon closure of the lid part each recess interacts with the edge of a collar rim so that in the closed state of the box at least a part of the collar rim comes to rest between the outside of the lid front wall and the strengthening field, wherein each recess is v-shaped, the edges of each recess are curved, and the deepest point of each recess lies roughly at mid-height of the strengthening field, and wherein each of the top corners of the strengthening field is provided with an embossed area.

4. The container blank according to claim 3, wherein one or more of the longitudinal edges of the box part, of the lid part and of the collar is one of rounded or chamfered.

5. The container blank according to claim 3, wherein the foldable material is paper.

6. The container blank according to claim 5, wherein the foldable material is shortgrain paper.

7. The container blank according to claim 3, wherein each recess extends from the top edge of the strengthening field over approximately 50 to 90% of the height of the strengthening field.

8. The container blank according to claim 3, wherein the embossed area extends inwards from the top edge of the strengthening field toward a central region of the strengthening field and extends inwards from the top edge of each recess towards the central region of the strengthening field.

9. The container blank according to claim 3, wherein the embossed area approximately corresponds to the thickness of the foldable material.

10. The container blank according to claim 3, wherein the container blank is a cigarette package.

11. The container blank according to claim 3, wherein each recess extends from the top edge of the strengthening field over approximately 60 to 70% of the height of the strengthening field.

12. Container blank made of foldable material with a box part, the box part having a box front wall, a box rear wall, box side walls and a box base, with a lid part, the lid part having a lid front wall, a lid rear wall, lid side walls and a lid top side, and with a collar, the collar having a collar front wall provided with a cut-out section and collar side walls, the lid part being linked with the lid rear wall on the box rear wall, the collar being arranged in the box part, and the collar front wall projecting at least partly out of the box part, wherein the rim of the collar front wall remaining on the left and right next to the cut-out section is so narrow that it projects forward due to the rigidity of the foldable material, in at least its upper area, wherein the inside of the lid front wall is formed by a strengthening field having a recess on each side of the strengthening field and wherein each recess is shaped such that upon closure of the lid part it interacts with the edge of a collar rim so that in the closed state of the box at least a part of the collar rim comes to rest between the outside of the lid front wall and the strengthening field, wherein each of the top corners of the strengthening field is provided with an embossed area, wherein each recess is v-shaped, the edges of each recess is curved, the deepest point of each recess lies roughly at mid-height of the strengthening field, and each recess extends from the top edge of the strengthening field over approximately 50 to 90% of the height of the strengthening field.

* * * * *